US007230205B2

(12) United States Patent
Twerdochlib

(10) Patent No.: US 7,230,205 B2
(45) Date of Patent: Jun. 12, 2007

(54) COMPRESSOR AIRFOIL SURFACE WETTING AND ICING DETECTION SYSTEM

(75) Inventor: Michael Twerdochlib, Oviedo, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 0 days.

(21) Appl. No.: 11/093,126

(22) Filed: Mar. 29, 2005

(65) Prior Publication Data

US 2006/0237416 A1 Oct. 26, 2006

(51) Int. Cl.
*H05B 1/00* (2006.01)

(52) U.S. Cl. ..... 219/201; 244/134 R; 244/134 D

(58) Field of Classification Search ..... 219/201, 219/200, 543, 544; 244/134 R, 134 F
See application file for complete search history.

(56) References Cited

U.S. PATENT DOCUMENTS

| | | | | |
|---|---|---|---|---|
| 3,183,975 | A | 5/1965 | Keen | |
| 3,287,974 | A * | 11/1966 | Ciemochowski | 374/28 |
| 3,421,374 | A * | 1/1969 | Lawrence et al. | 374/184 |
| 3,834,157 | A | 9/1974 | Hoffmann | |
| 3,866,109 | A | 2/1975 | Reed et al. | |
| 3,925,979 | A | 12/1975 | Ziegler | |
| 4,222,044 | A | 9/1980 | Boschung | |
| 4,410,794 | A | 10/1983 | Williams | |
| 4,550,564 | A | 11/1985 | Callahan et al. | |
| 4,782,658 | A | 11/1988 | Perry | |
| 4,821,758 | A | 4/1989 | Ruis | |
| 5,157,914 | A | 10/1992 | Schwarz et al. | |
| 5,281,091 | A | 1/1994 | Dooley et al. | |
| 5,351,918 | A | 10/1994 | Giamati et al. | |
| 5,423,174 | A | 6/1995 | Mouton | |
| 5,538,796 | A * | 7/1996 | Schaffer et al. | 428/469 |
| 5,657,951 | A | 8/1997 | Giamati | |
| 5,764,065 | A * | 6/1998 | Richards et al. | 324/551 |
| 5,878,566 | A | 3/1999 | Endo et al. | |
| 5,934,617 | A | 8/1999 | Rutherford | |
| 6,014,029 | A * | 1/2000 | Soto et al. | 324/664 |
| 6,194,685 | B1 | 2/2001 | Rutherford | |
| 6,431,824 | B2 | 8/2002 | Schotsch et al. | |
| 6,442,944 | B1 | 9/2002 | Skur, III | |
| 6,487,862 | B1 | 12/2002 | Doorley | |
| 6,725,645 | B1 | 4/2004 | Wadia et al. | |
| 2002/0194733 | A1 * | 12/2002 | Surace et al. | 29/889.1 |
| 2005/0073673 | A1 * | 4/2005 | Devitt et al. | 356/37 |
| 2006/0137179 | A1 * | 6/2006 | Gorman et al. | 29/889.1 |

FOREIGN PATENT DOCUMENTS

| | | |
|---|---|---|
| EP | 0678160 A1 | 10/1995 |
| WO | WO 95/13467 | 5/1995 |

* cited by examiner

*Primary Examiner*—Robin Evans
*Assistant Examiner*—Vinod Patel

(57) ABSTRACT

In some instances, ice can form on the surface of a compressor airfoil. If the ice dislodges, it can impact and damage other compressor components. Aspects of the invention relate to systems for detecting the presence of ice or water on a compressor vane during engine operation. A ceramic insulating coating can be deposited on a portion of the surface of the vane. A heater and a thermocouple can be provided near the outermost surface of the coating such that the thermocouple can sense heat from the heater. The heater and the thermocouple can be provided within the coating. The presence of water film and/or ice on the coating surface can be detected by taking a thermocouple measurement following a heater pulse. The presence of a water film or ice results in a delay in the temperature rise detected by the thermocouple.

18 Claims, 12 Drawing Sheets

COMPRESSOR AIRFOIL SURFACE WETTING AND ICING DETECTION SYSTEM

FIELD OF THE INVENTION

The invention relates in general to turbine engines and, more specifically, to the compressor section of a turbine engine.

BACKGROUND OF THE INVENTION

Under certain circumstances, ice can form inside of the compressor section of a turbine engine. Ice formation requires both adherence of moisture to a surface and a reduction in temperature. Water can enter a compressor in several ways. For example, water is sometimes injected into the compressor to increase power by wet compression. In some instances, the air drawn into the compressor may be moist because of the prevailing weather conditions (i.e., high humidity). As the air travels through the compressor, the moisture in the air can contact and adhere to various surfaces in the compressor, such as to a stationary vane.

There are situations in which the temperature of the air in the compressor can drop to or below the freezing point of water. For instance, when the inlet guide vanes are closed beyond certain values, a large pressure drop can occur, which, in turn, can induce a corresponding drop in the temperature of the air flowing though the compressor. These conditions can foster the formation of ice on the surface of the vane. If the ice dislodges from the vane during engine operation, the ice can impact and damage other components in the compressor, such as blades and other vanes. Such damage can result in time-consuming, labor intensive and costly repairs. Thus, there is a need for a system that can at least detect the presence of moisture and/or ice on at least a part of the surface of a compressor airfoil.

SUMMARY OF THE INVENTION

One surface wetting and icing detection system according to aspects of the invention can be applied in connection with a turbine engine compressor, which can be, for example, an airfoil. The component has a surface. An insulating coating is applied on at least a portion of the component surface. The coating has an outermost surface. The coating can be thermal barrier coating, silicone oxide, zirconium, aluminum oxide, and magnesium fluoride. In one embodiment, the distance between the component surface and the outermost surface of the coating is no more than about 0.040 inch.

The system includes a heater and a power source for selectively activating the heater. A pair of heater leads can extend from the heater. Each of the heater leads can be electrically connected to the power source by conductors. The heater is provided proximate the outermost surface so as to selectively provide heat to the outermost surface. In one embodiment, the thermocouple and the heater are no more than about 0.010 inch thick.

The system further includes a first thermocouple that is provided proximate the outermost surface. The first thermocouple has a first lead and a second lead. A portion of the first lead is electrically connected to a portion of the second lead to form a first thermocouple junction. The first thermocouple junction is positioned proximate the heater so as to sense heat from the heater. In one embodiment, the first thermocouple junction is located between the heater and the outermost surface of the coating. The heater and the thermocouple can be electrically insulated by the coating.

According to aspects of the invention, the system also includes a detection circuit operatively connected to the first thermocouple. For example, each of the thermocouple leads can be operatively connected to the detection circuit by conductors. The detection circuit measures voltage at the first thermocouple junction and converts the measured voltage into a temperature value. When no water and ice is present on the outermost surface, the thermocouple measures a base temperature value in response to a heater pulse. When water and/or ice is present on the outermost surface, the thermocouple measures a measured temperature value in response to a heater pulse. In such case, the measured temperature value will be less than base temperature value. Thus, the lower measured temperature value can alert an operator of the presence of at least one of ice and water on the compressor component.

In one embodiment, the coating can include a plurality of layers. For instance, the heater can be electrically insulated from the component surface by a first layer, and the first thermocouple can be electrically insulated from the heater by a second layer. A third layer of coating can cooperate with the second layer to substantially cover the first thermocouple. The third layer can also define the outermost surface of the coating.

The system can include a second thermocouple that is provided proximate the outermost surface so as to be electrically insulated from the heater. The second thermocouple can include a first thermocouple lead and a second thermocouple lead. A portion of the first lead can be electrically connected to a portion of the second lead to form a second thermocouple junction. The second thermocouple junction is located remotely from the heater so that the second thermocouple junction does not substantially sense heat generated by the heater. The second thermocouple can be operatively connected to the power source. Further, the second thermocouple can electrically connected in series and in opposing polarity to the first thermocouple. Such a dual thermocouple arrangement can minimizes any contribution to the thermocouple voltage reading that is attributable to non-heater sources.

Aspects of the invention are directed to a second embodiment of a surface wetting and icing detection system. The system can be used in connection with a turbine engine compressor component, which can be an airfoil. The component has a surface. An insulating coating is applied on at least a portion of the component surface. The coating can be one of thermal barrier coating, silicone oxide, zirconium, aluminum oxide, and magnesium fluoride. The coating has an outermost surface.

The system includes an oscillator circuit that has an associated reference frequency. The oscillator circuit can be a Colpitts oscillator circuit. The system further includes a capacitor that has an associated capacitance. The capacitor is provided proximate the outermost surface. The capacitor is operatively connected to and forms a part of the oscillator circuit. In one embodiment, the capacitor can include a first capacitor lead and a second capacitor lead. A plurality of fingers can project from a portion of each capacitor lead. The capacitor leads can be arranged such that fingers of the first capacitor lead are alternatingly interspaced with the fingers of the second capacitor lead.

When water and/or ice is present on the outermost surface, the capacitance of the capacitor increases. As a result, there is a decrease in the frequency of the oscillator circuit. Thus, the frequency decrease can alert an operator of the presence of at least one of ice and water on the compressor component.

In one embodiment, the system can include a heater and a power source for selectively activating the heater. The heater can be provided proximate to the outermost surface so that when heater is activated, the outermost surface and/or a portion of the surface can be deiced and/or dried.

When a heater is provided, the system can also include a thermocouple and a detection circuit operatively connected to the thermocouple. The thermocouple can be provided proximate the outermost surface. The thermocouple can have a first lead and a second lead. A portion of the first lead can be electrically connected to a portion of the second lead to form a first thermocouple junction. The thermocouple junction can be disposed proximate the heater so as to sense heat from the heater. In one embodiment, the thermocouple junction can be located between the heater and the outermost surface of the coating. In such case, the heater and the thermocouple can be electrically insulated from each other by the coating.

A detection circuit can be operatively connected to the thermocouple. The detection circuit can measure voltage at the thermocouple junction and convert the measured voltage into a temperature value. Thus, the thermocouple can be used to confirm the presence of ice and/or water on the compressor component.

Aspects of the invention include a third embodiment of a surface wetting and icing detection system for a turbine engine compressor. The system is used in connection with a turbine engine compressor component. The component has a surface. An insulating coating is applied on at least a portion of the component surface. The coating has an outermost surface. In one embodiment, the coating is ceramic.

The system includes a capacitance bridge circuit. A first capacitor is operatively connected to and forms a part of the capacitance bridge circuit; a second capacitor is operatively connected to and forming a part of the capacitance bridge circuit. The first and second capacitors are provided proximate the outermost surface, such as within the coating.

A first heater is provided proximate the outermost surface so as to selectively provide heat to the outermost surface. The first heater is also proximate the first capacitor. A second heater is provided proximate the outermost surface so as to selectively provide heat to the outermost surface. The second heater is further proximate the second capacitor. The system also includes a power source for selectively activating the first and second heaters.

When no ice or water is present on the outermost surface proximate at least one of the capacitors, the capacitance bridge circuit is substantially balanced. However, when water and/or ice is present on the outermost surface proximate at least one of the capacitors, the capacitance bridge circuit becomes unbalanced, thereby producing a voltage signal, which can alert an operator as to the presence of water and/or ice.

The system can further include a first thermocouple, a second thermocouple and a detection circuit operatively connected to the first and second thermocouples. The first thermocouple can be provided proximate the outermost surface. The first thermocouple can have a first lead and a second lead. A portion of the first lead can be electrically connected to a portion of the second lead to form a first thermocouple junction. The first thermocouple junction can be positioned proximate the first heater so as to sense heat from the first heater.

The second thermocouple can be provided proximate the outermost surface. The second thermocouple can have a first lead and a second lead. A portion of the first lead can be electrically connected to a portion of the second lead to form a second thermocouple junction. The second thermocouple junction can be positioned proximate the second heater so as to sense heat from the second heater.

The detection circuit can measure voltage at each of the thermocouple junctions and convert the measured voltages into a temperature value. Thus, the thermocouples can be used to confirm the presence of ice and/or water on the compressor component detected by the capacitance bridge circuit.

DETAILED DESCRIPTION OF EMBODIMENTS OF THE INVENTION

Embodiments of the present invention are directed to systems for detecting the presence ice or water on the surface of a compressor airfoil. In addition to detection, some of the systems according to aspects of the invention can be configured to facilitate removal of water and/or ice from the airfoil surface. Embodiments of the invention will be explained in the context of several possible systems, but the detailed description is intended only as exemplary. Embodiments of the invention are shown in FIGS. 1–13, but the present invention is not limited to the illustrated structure or application.

Figure 1:
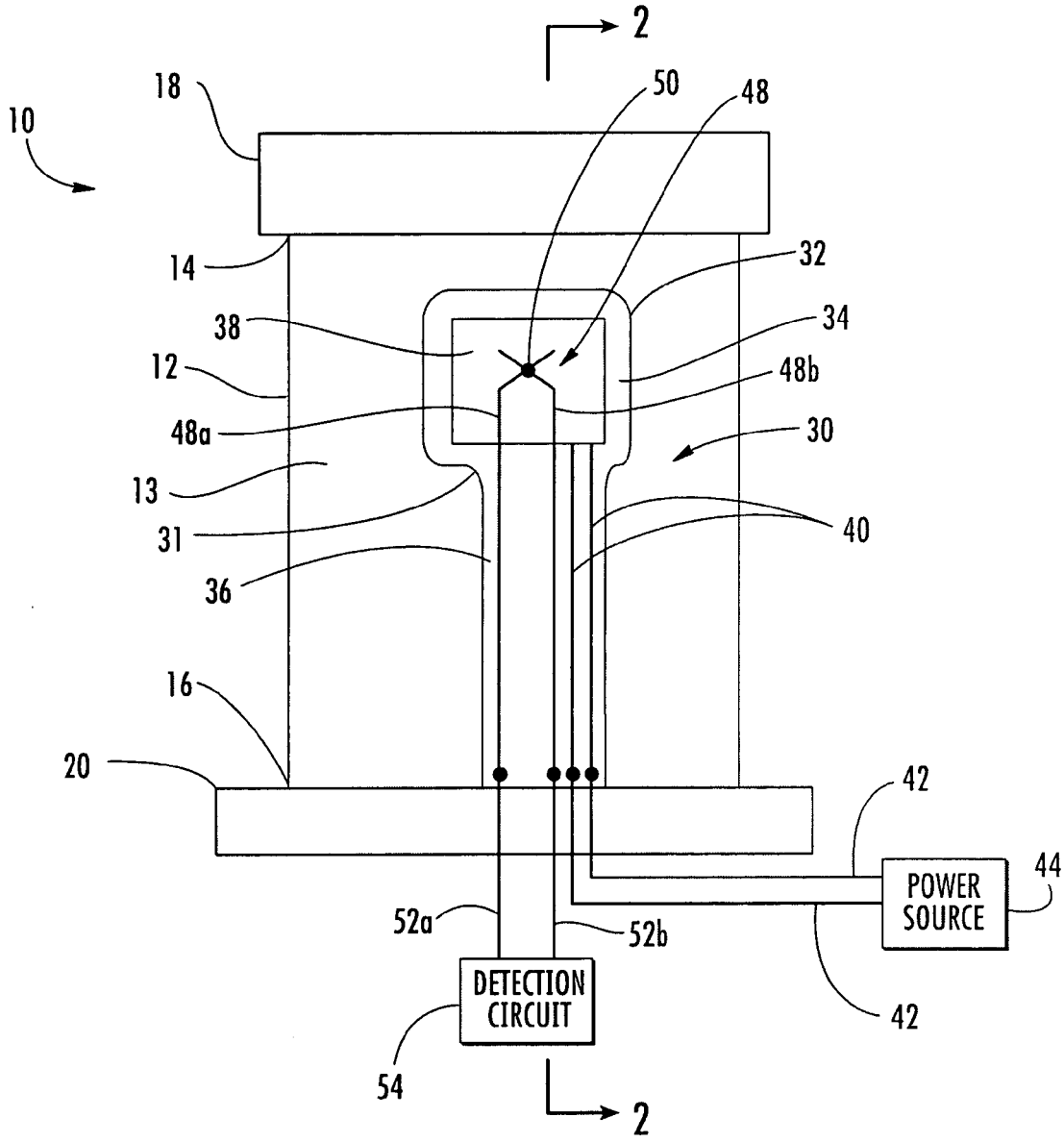
FIG. 1 is a side elevational view of a compressor vane with a first detection system according to aspects of the invention, wherein the second and third layers of insulating material are removed for clarity.

Aspects of the invention can be used in connection with various compressor components. Preferably, aspects of the invention are used in combination with a compressor vane. As shown in FIG. 1, a compressor vane 10 can include an elongated airfoil 12 that has an outer peripheral surface 13 as well as a radial inner end 14 and a radial outer end 16. The terms "radial inner" and "radial outer," as used herein, are intended to refer to the positions of the ends 14, 16 of the airfoil 12 relative to the compressor when the vane 10 is installed in its operational position. The airfoil 12 can be made of any of a number of materials including, for example, metals, ceramic matrix composites or super alloys.

At least one of the radial ends 14, 16 of the airfoil 12 can be attached to a shroud. For example, the radial inner end 14 of the airfoil 12 can be attached to an inner shroud 18. In addition, the radial outer end 16 of the airfoil 12 can be attached to an outer shroud 20. The outer shroud 20 can be adapted to facilitate attachment to a surrounding stationary support structure, such as a vane carrier or compressor casing (not shown). The inner and outer shrouds 18, 20 can enclose a single airfoil 12 or multiple circumferentially spaced airfoils, such as in the form of a diaphragm pack.

Figure 2:
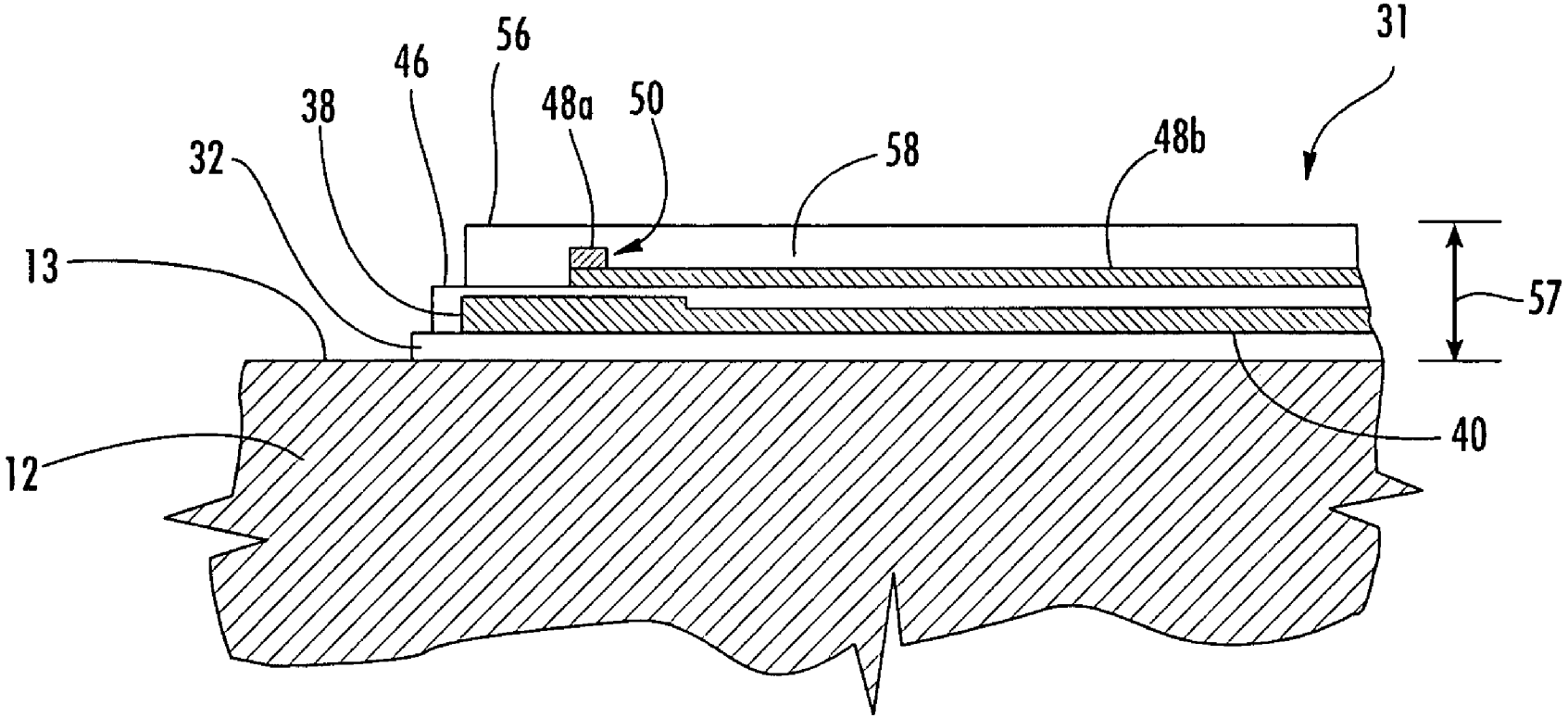
FIG. 2 is a cross-sectional view of the first detection system according to aspects of the invention, viewed from line 2—2 in FIG. 1.

A system 30 for detecting ice or water on the surface of a compressor component according to aspects of the invention is shown in FIGS. 1–2. The system 30 can be provided on the outer peripheral surface 13 of the vane airfoil 12. To that end, an insulating coating material 31 can be applied to a part of the outer peripheral surface 13 of the airfoil 12. The insulating material 31 can be provided in the form of a thin film. The insulating material 31 can be made of ceramic, such as thermal barrier coating, silicon oxide, zirconium, aluminum oxide, and magnesium fluoride.

The insulating coating 31 can be provided in one or more layers. The thickness of an individual layer of insulating material 32 can be about 0.001 inch or less. Ideally, the insulating material 31 is of a substantially uniform thickness. The insulating material 31 can be applied to the outer peripheral surface 13 of the airfoil 12 using plasma deposition or maskless mesoscale materials deposition. Such processes can be automated so as to make the application of the insulating material fast, uniform, controlled and repeatable.

The insulating material 31 can have any conformation, and aspects of the invention are not limited to any specific shape. It will be appreciated that the size and shape of the insulating material can substantially correspond to the area covered by the other components of the system 30, which will be discussed later. In one embodiment, a first layer of insulating material 32 can include a first portion 34 and a second portion 36. The first portion 34 can be located anywhere on the airfoil 12, but preferably it is located an area of the airfoil 12 that experience has shown is prone to ice formation. In one embodiment, the first portion 34 can be substantially square in conformation, such as approximately one centimeter on a side. The second portion 36 can extend from the first portion 34 and toward the radial outer end 16 of the airfoil 12. In one embodiment, the second portion 36 can be substantially rectangular in conformation.

Figure 12:
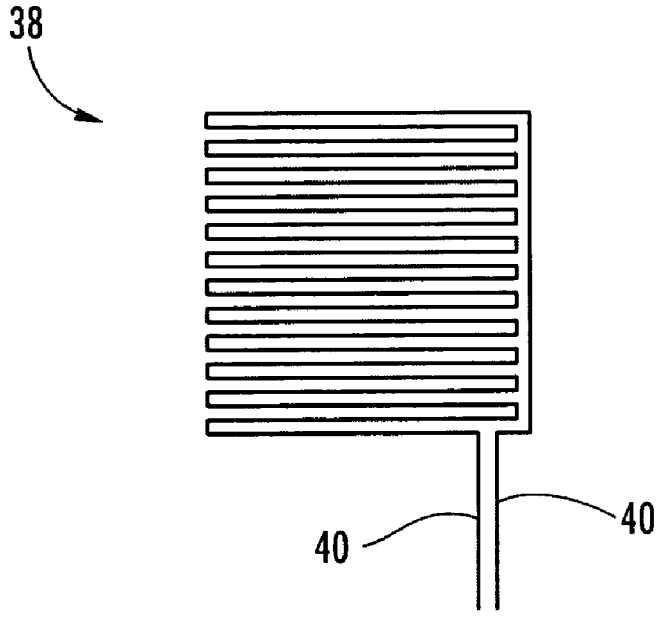
FIG. 12 is a top plan view of one configuration for a heater according to aspects of the invention.
Figure 13:
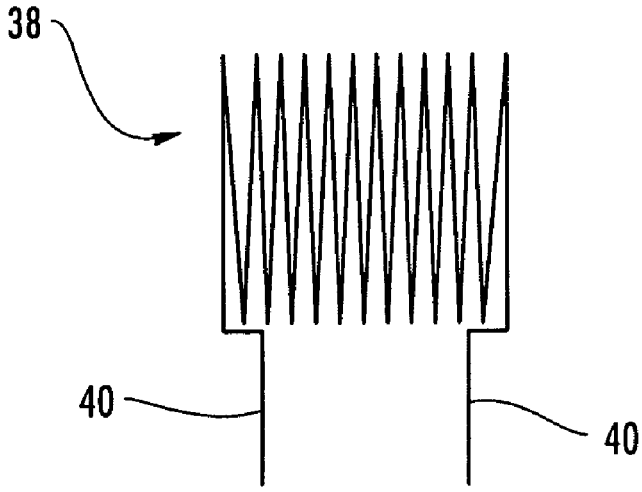
FIG. 13 is a top plan view of one configuration for a heater according to aspects of the invention.

A heater 38 can be applied on the first layer of insulating material 32, such as on the first portion 34. The heater 38 can be formed by a length of conductor that is shaped in a winding path so as to permit a relatively large total length of conductor to be placed in a relatively small region. Various configurations for the heater 38 are possible within the scope of the invention. FIGS. 12 and 13 show two possible configurations for the heater 38; these configurations are merely examples and aspects of the invention are not limited to the embodiments shown. The heater 38 can be almost any size and shape. In one embodiment, the heater 38 can be confined within a substantially rectangular area. It will be understood that the heater 38 can be confined within areas of other shapes including circular, triangular, oval, polygonal, etc. A pair of heater leads 40 can be electrically connected to the heater 38 and can extend therefrom. In one embodiment, a substantial portion of the heater leads 40 can extend on the second portion 36 of the insulating material 32. Due to such an arrangement, it will be appreciated that the insulating material 32 can electrically insulate the heater 38 and the heater leads 40 from the outer peripheral surface 13 of the airfoil 12. While it is preferred if the heater leads 40 are provided on a single layer of insulating material, the heater leads 40 can span across more than one of the layers of insulating material discussed herein.

The heater 38 and the heater leads 40 can be provided on the insulating material 32 by, for example, plasma deposition. In such case, the heater 38 and the heater leads 40 can be deposited as a unitary structure. Alternatively, the heater 38 and the heater leads 40 can be initially separate components that are subsequently electrically connected. In such case, at least one of the heater 38 and the heater leads 40 can be manually positioned on the insulating material 32. Again, these are just a few of the ways in which the heater 38 and the heater leads 40 can be provided.

Preferably, material selection for and sizing of the heater 38 and the heater leads 40 are made so that the resistance of the heater 38 is substantially greater than the resistance of the heater leads 40. In one embodiment, the heater 38 can be made of platinum alloys or nickel chrome alloys. The heater leads 40 can be made of silver, gold, platinum alloys, or nickel chrome alloys. Ideally, the heater 38 and the heater leads 40 are as thin as possible. Preferably, the cross-sectional area of the heater 40 is smaller than the cross-sectional area of the heater leads 40. In one embodiment, the heater 38 can be approximately 0.004 inch thick and approximately 0.010 inch wide in cross-section. The heater leads 40 can be about 0.200 millimeter thick by about 0.020 millimeter wide in cross-section. The heater 38 and the heater leads 40 can have substantially the same thickness, or they can have different thicknesses. Further, the thickness of the heater 38 and/or the heater leads 40 can be substantially uniform, or the thickness of at least one of these component may not be substantially uniform.

Each of the heater leads 40 can be electrically connected to a conductor 42. The electrical connection between the heater leads 40 and the conductors 42 can occur on the airfoil 12, preferably near the outer radial end 16 of the airfoil 12. Alternatively, the connection can occur on the outer shroud 20. The conductors 42 can extend outside of the compressor (not shown). The conductors 42 can be electrically connected to a power source 44, which can be an alternating or direct current source. When the power source 44 supplies current to the heater 38 by way of the leads 40, the heater 38 can emit energy as heat, such as about 10 Watts.

A second layer of insulating material 46 can be applied so as to substantially encapsulate the exposed surfaces of the heater 38 and the heater leads 40. The above discussion regarding the first layer of insulating material 32 is equally applicable to the second layer of insulating material 46 and is incorporated by reference.

A thermocouple 48 can be applied on the second layer of insulating material 46, which can electrically insulate the thermocouple 48 from the heater 38 and the heater leads 40. The thermocouple 48 can include a first thermocouple lead 48*a* and a second thermocouple lead 48*b*. The thermocouple leads 48*a*, 48*b* can extend over the second layer of insulating material 46 so as to be separated from each other. The first and second thermocouple leads 48*a*, 48*b* are made of different materials. For instance, one of the thermocouple leads 48*a* can be made of a nickel chrome alloy, and the other thermocouple lead 48*b* can be made of a nickel aluminum alloy.

At one point, the first and second thermocouple leads 48*a*, 48*b* can overlap each other; that is, one of the thermocouple leads can extend over the other thermocouple lead. In the area of overlap, the thermocouple leads 48*a*, 48*b* can be electrically connected to form a thermocouple junction 50.

Preferably, the thermocouple junction 50 is located substantially directly over the heater 38. In one embodiment, the thermocouple junction 50 can be substantially centered over the heater 38.

The thermocouple leads 48*a*, 48*b* can be any size, but it is preferred if the thermocouple leads 48*a*, 48*b* are as small as possible. In one embodiment, the cross-sectional dimensions of the thermocouple leads 48*a*, 48*b* can be about 0.008 inches by about 0.001 inches. In another embodiment, the thermocouple leads 48*a*, 48*b* can be about 0.200 millimeters by about 0.020 millimeter in cross-section. The thermocouple leads 48*a*, 48*b* can have any cross-sectional shape. For instance, the thermocouple leads 48*a*, 48*b* can be circular, semi-circular, square or rectangular, just to name a few possibilities. In one embodiment, the thermocouple leads 48*a*, 48*b* can be deposited on the second insulating layer 46 by a vapor or plasma deposition process. Alternatively, the thermocouple leads 48*a*, 48*b* can be bare conductors that are manually laid upon the second insulating layer 46. While it is preferred if the thermocouple leads 48*a*, 48*b* are provided on a single layer of insulating material, the thermocouple leads 48*a*, 48*b* can be provided on more than one layer and can extend through any of the layers of insulating material discussed herein.

Each of the thermocouple leads 48*a*, 48*b* can be electrically connected to a respective conductor 52*a*, 52*b*, which can extend outside of the compressor. Preferably, each of the conductors 52*a*, 52*b* is made of the same material or a substantially identical material as the thermocouple lead 48*a*, 48*b* to which it is connected. The conductors 52*a*, 52*b* can be electrically connected, directly or indirectly, with a detection circuit 54, which can convert the measured thermocouple junction voltage into temperature.

A third layer of insulating material 56 can be applied over the exposed portions of the thermocouple 48. The third layer of insulating material 56 can provide environmental protection to the thermocouple 48 and the components beneath. The above discussion of the first layer of insulating material 32 applies equally here and is incorporated by reference. It should be noted that the various layers of insulating material 32, 46, 56 can have the same thickness and be made of the same material, but at least one of the insulating layers 32, 46, 56 can be different in either of these respects. While a portion of one layer overlaps at least a portion of an adjacent layer, the layers of insulating material 32, 46, 56 can but need not have substantially identical areas of coverage. Further, it will be appreciated that providing thin films of insulating material is only one of many ways to electrically insulate the various components of the system.

Ideally, the overall distance 57 between the outer peripheral surface 13 of the airfoil and the outermost surface 58 of the third layer of insulating material 56 (or the otherwise outermost protective material) should be kept as thin as possible so as not to have an appreciable effect on the aerodynamic performance of the compressor. In one embodiment, the overall distance 57 is no more than about 0.040 inch.

One manner of using the system 30 according to aspects of the invention will now be described. The following description is merely an example, and it is not intended to limit the scope of the invention. An electronic input can be sent to the heater 38 from the power source 44. In one embodiment, the input can be a step function. The heater 38 can be pulsed at regular or irregular intervals. For each heater pulse, a thermocouple reading can be made by the circuit 44. Thus, it will be appreciated that the heater 38 should be able to generate sufficient heat so as to trigger a response by the thermocouple 48.

When there is no water or ice on the outer peripheral surface 13 of the airfoil 12 or, more particularly, on the outermost surface 58 of the third layer of insulating material 56, the thermocouple 48 can respond to the temperature rise caused by the pulse from the heater 38. The thermocouple 48 can measure the temperature increase after a heater pulse so as to establish a base temperature response value Tb, which can be the peak temperature measured after a heater pulse. The amount of time it takes for the thermocouple 48 to register the base temperature response value Tb after a heater pulse can be measured to establish a base rate Rb.

However, when water or ice is present, the measured rate of response Rm of the thermocouple 48 to the heater pulse can be less than the base rate Rb. The temperature response value Tm measured by the thermocouple 48 can be less than the base temperature response value Tb. The difference between the measured temperature response value Tm and the base temperature response value Tb can be on of the order of a few degrees Fahrenheit. The lower measured response rate Rm and measured temperature response valve Tm can be attributed to the added water mass that must now be heated by the heater pulse. In other words, there is an increase in heat capacity of the environment including and surrounding the heater 38.

A system according to aspects of the invention can employ one or both of these detection techniques (response rate and/or temperature response value). The lower measured response rate Rm and the reduced measured temperature response value Tm not only depends on the presence of ice or water, but also the quantity of ice or water present, particularly in the area directly above the heater 38. For instance, a given quantity of ice can give a larger response than the same quantity of water. In contrast, the response of a given quantity of ice and a small quantity of water can result in substantially the same reduction in the measured response rate Rm and the measured temperature response value Tm. Thus, the system cannot necessarily distinguish between whether ice or water is present. The form of the water can be identified by actually melting the ice with the heater 38, which requires a very large amount of heat, with no change in temperature (as the ice melts).

In any event, the reduction in the temperature response value Tm or response rate Rm can alert an operator that ice or water is present. With this information, the operator can take steps necessary to avoid the potential damage that can be caused by ice in the compressor. For instance, the operator can shut down the engine. Alternatively, the operator can change the operating conditions, such as by changing the position of the inlet guide vanes or by dehumidifying the intake air. While the system 30 can primarily be used for detection, it may be possible to deice at least a portion of the airfoil 12 by keeping the heater 38 activated for a sufficient amount of time to melt any nearby ice. In such case, it is preferred if the heater 38 covers at least a substantial portion of the airfoil 12 and all such airfoils 12 in a given row.

Figure 3:
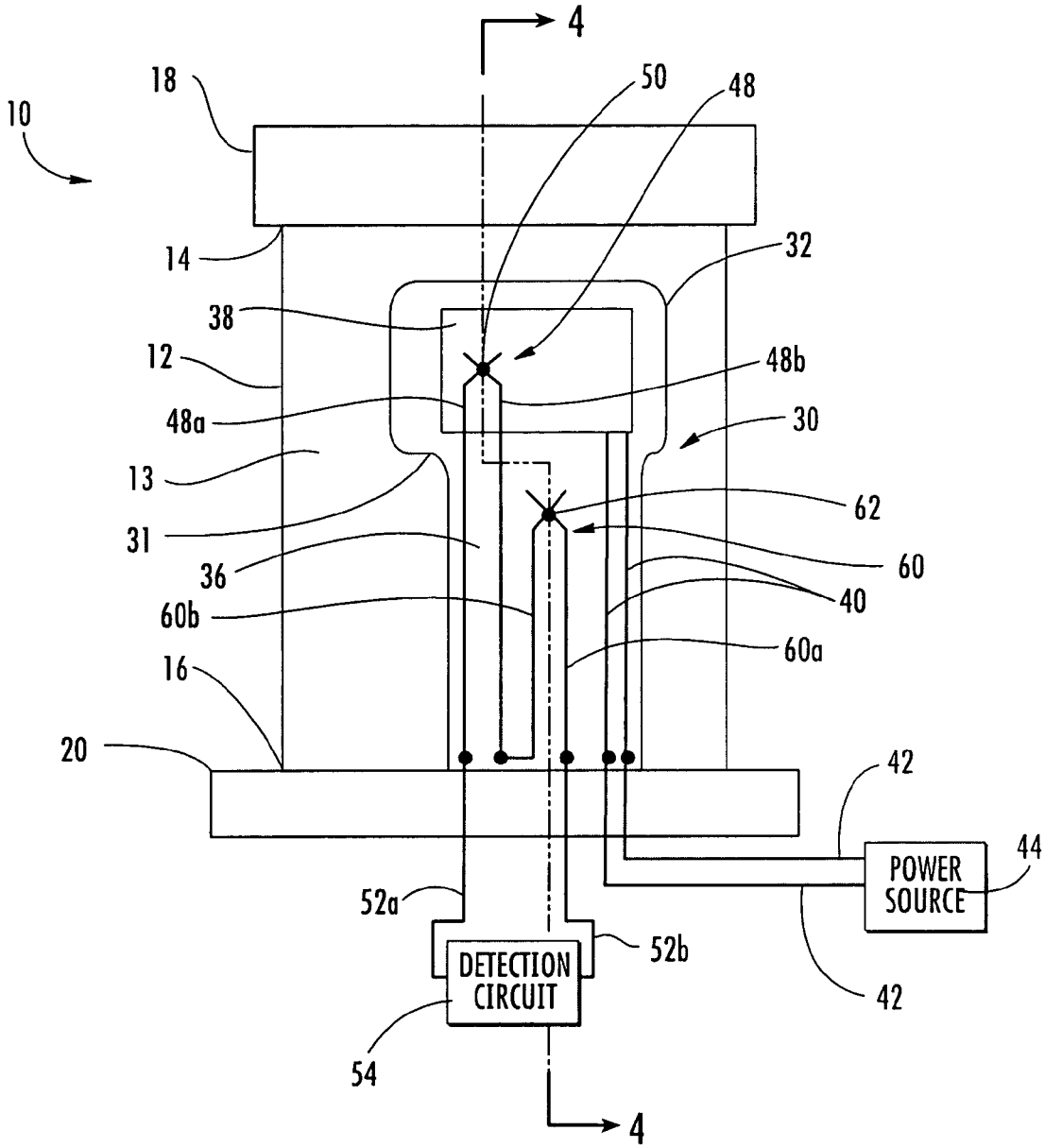
FIG. 3 is a side elevational view of a compressor vane with an alternative embodiment of the first detection system according to aspects of the invention, wherein the second and third layers of insulating material are removed for clarity.
Figure 4:
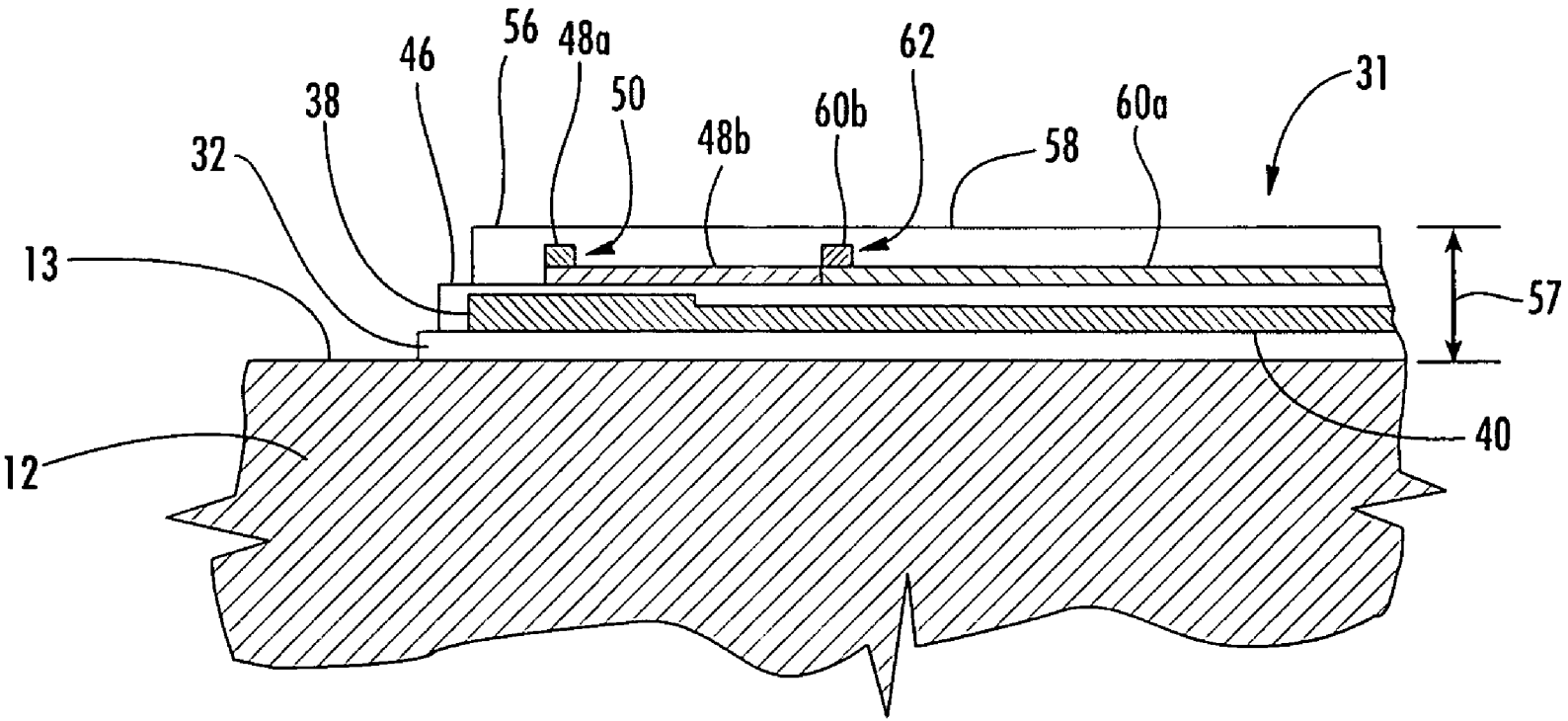
FIG. 4 is a cross-sectional view of the alternative embodiment of the first detection system according to aspects of the invention, viewed from line 4—4 in FIG. 3.

The system 30 according to aspects of the invention can provide an indication of whether ice or water is present; however, the system 30 does not account for any influence that the base material of the airfoil 12 can have on the response of the thermocouple 48. To minimize such concerns and to increase sensitivity, the system 30 can further include a dual thermocouple system, as shown in FIGS. 3–4. Except for the connection of the second thermocouple lead 48*b*, which will be discussed later, the previous discussion of the first thermocouple 48 applies here.

The dual thermocouple arrangement according to aspects of the invention can include a second thermocouple 60. The second thermocouple 60 can include a first thermocouple lead 60*a* and a second thermocouple lead 60*b*. The first thermocouple lead 60*a* and the second thermocouple lead 60*b* are made of different materials. The thermocouple leads 60*a*, 60*b* can extend over the second layer of insulating material 46 so as to be separated from each other. The second layer of insulating material 46 can electrically insulate the second thermocouple 60 from the heater 38 and/or the heater leads 40. At one point, the thermocouple leads 60*a*, 60*b* can contact each other to form a thermocouple junction 62. The second thermocouple 60, including the junction 62 and the thermocouple leads 60*a*, 60*b*, can be placed near the heater 38, but it is preferred if the thermocouple 60 is located sufficiently away from the heater so as not to be affected by a heater pulse. The previous discussion relating to the size, shape and method of providing the first thermocouple 48 applies equally to the second thermocouple 60 and is incorporated by reference.

Preferably, the first and second thermocouples are provided on the same layer of insulating material, such as the second layer 46, but aspects of the invention are not limited to such an arrangement. In any case, it is preferred if the overall distance 57 between the outer peripheral surface 13 of the airfoil and the outermost surface 58 of the third layer of insulating material 56 (or the otherwise outermost protective material) should be kept as thin as possible so as not to have an appreciable effect on the aerodynamic performance of the compressor. In one embodiment, the overall distance 57 is no more than about 0.040 inch.

The second thermocouple 60 can be placed in opposing polarity and in series with the first thermocouple 48, as shown in FIG. 3. For example, the first thermocouple lead 48*a* of the first thermocouple 48 and the first thermocouple lead 60*a* of the second thermocouple 60 can be made of the substantially the same material M1. Likewise, the second thermocouple lead 48*b* of the first thermocouple 48 and the second thermocouple lead 60*b* of the second thermocouple 60 can be made of the substantially the same material M2. In such case, the thermocouples 48, 60 can be placed in opposing polarity by electrically connecting the second thermocouple lead 48*b* of the first thermocouple 48 with the second thermocouple lead 60*b* of the second thermocouple 60. The first thermocouple leads 48*a*, 60*a* can be electrically connected to a respective conductor 52*a*, 52*b*. The conductors 52*a*, 52*b* can extend outside of the compressor. The conductors 52*a*, 52*b* can be electrically connected, directly or indirectly, with the detection circuit 54, which can convert the measured thermocouple junction voltage difference into a temperature difference. Because the thermocouples 48, 60 are connected in series and in opposing polarity and assuming that the thermocouples 48*a*, 60*a* are at substantially the same temperature, the measured voltage across the first thermocouple leads 48*a*, 60*a* can be reduced to substantially zero. However, if the thermocouples 48, 60 are not at the same temperature (such as during a heater pulse), the two thermocouple voltages do not cancel. Thus, a voltage indicative of the difference between the two thermocouple temperatures can be measured across the first thermocouple leads 48*a*, 60*a*.

The operation of the system is substantially the same, as described above. However, the reading from the second thermocouple 60 can be used to subtract out any voltage at the thermocouple junction 48 attributable to the base airfoil temperature that is common to both thermocouples 48, 60. As a result, only the heater-induced temperature is reported.

Figure 5:
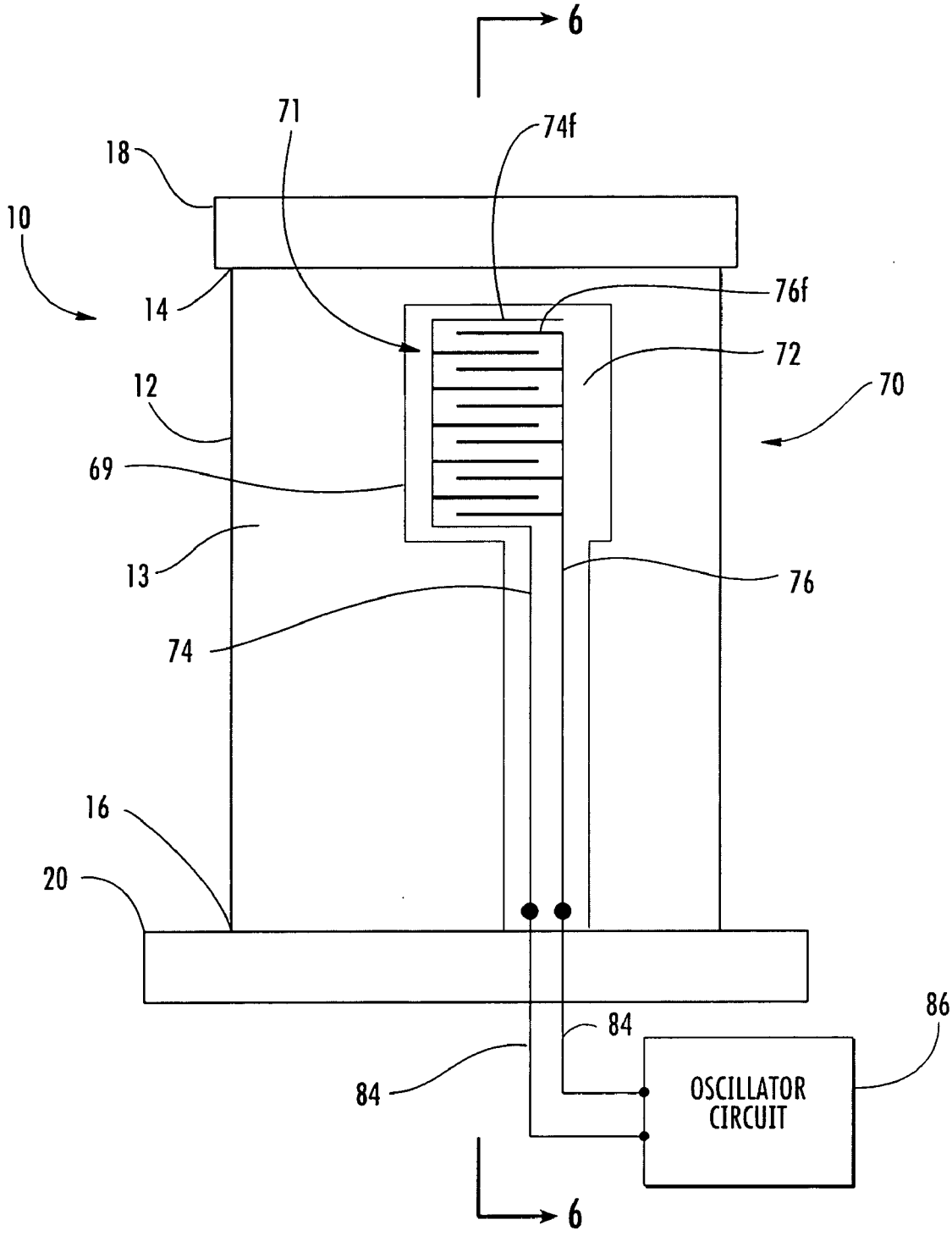
FIG. 5 is a side elevational view of a compressor vane with a second detection system according to aspects of the invention, wherein the second layer of insulating material is removed for clarity.
Figure 6:
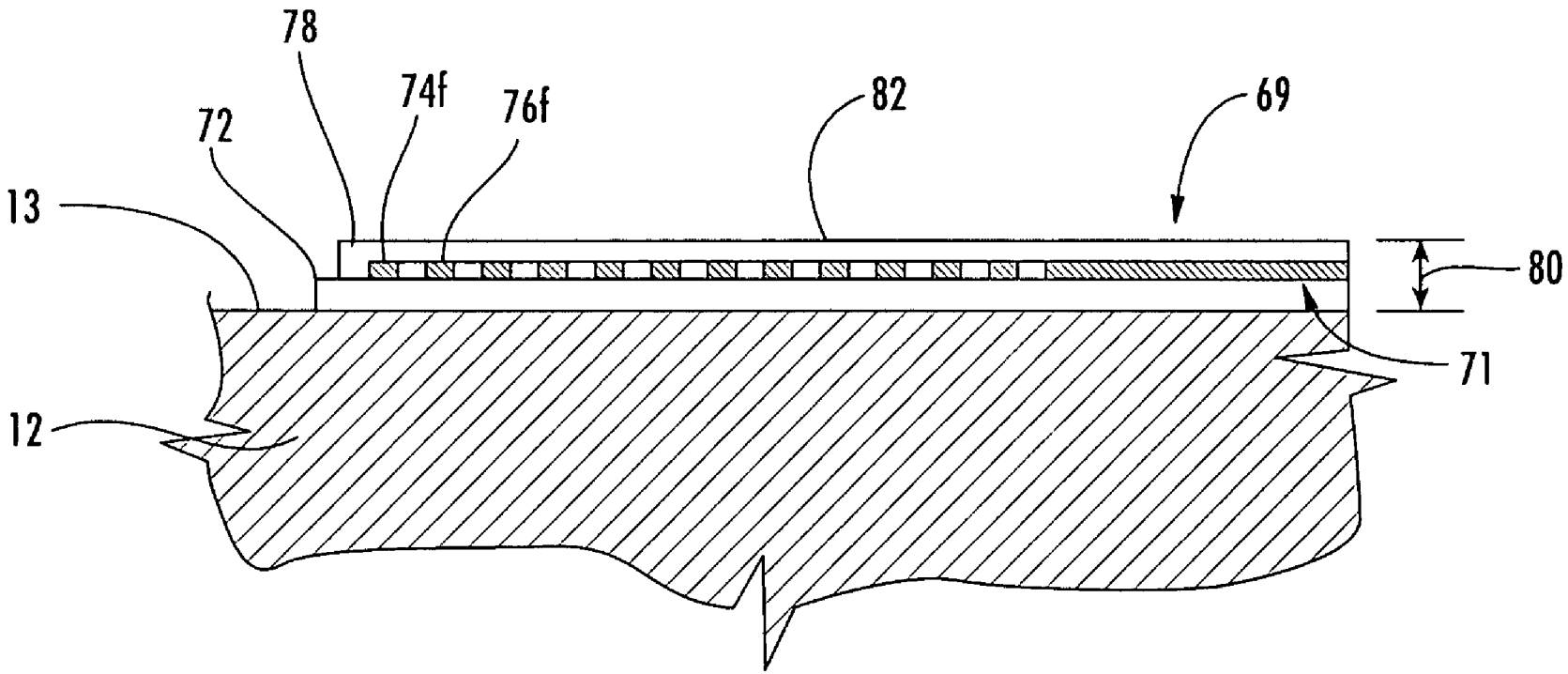
FIG. 6 is a cross-sectional view of the second detection system according to aspects of the invention, viewed from line 6—6 in FIG. 5.

Another system 70 for detecting ice or water on the surface of a compressor component is shown in FIGS. 5–6. According to aspects of the invention, the system 70 can be provided on the outer peripheral surface 13 of the vane airfoil 12. An insulating coating 69 can be applied to a part of the outer peripheral surface 13 of the airfoil 12, such as by plasma deposition. The coating 69 can be provided as a plurality of layers. A first layer of insulating material 72 can be applied to a part of the outer peripheral surface 13 of the airfoil 12. The earlier discussion of the insulating material 31 and the first layer of insulating material 32 in connection with the thermocouple-heater system 30 is equally applicable to the first layer of insulating material 72 and is incorporated by reference.

A capacitor 71 can be provided on the first layer of insulating material 72, which can electrically insulate the capacitor 71 from the airfoil 12. The capacitor 71 can have various configurations. In one embodiment, the capacitor 71 can include a first capacitor lead 74 and a second capacitor lead 76. Each of the capacitor leads 74, 76 can include a plurality of projecting fingers 74*f*, 76*f*. The fingers 74*f*, 76*f* on each capacitor lead 74, 76 can be substantially the same length or at least one finger can be a different length. Preferably, the fingers 74*f*, 76*f* on each lead 74, 76 are substantially parallel to each other. It is further preferred if the fingers 74*f*, 76*f* are provided at substantially regular intervals on each lead 74, 76.

The first and second capacitor leads 74, 76 can be arranged such that the fingers 74*f* of the first capacitor lead 74 are alternatingly interspaced with the fingers 76*f* of the second capacitor lead 76 such that the fingers 74*f*, 76*f* do not touch. Such an alternating arrangement of fingers 74*f*, 76*f* can form the capacitor 71 according to aspects of the invention. Preferably, there is a substantially constant spacing between the fingers 74*f*, 76*f*. As shown in FIG. 5, the alternatingly interspaced arrangement of the fingers 74*f*, 76*f* can form a capacitor 71 that is generally rectangular in shape, but aspects of the invention are not limited to this conformation as other shapes are possible. Likewise, aspects of the invention are not limited to any particular quantity of fingers on each capacitor lead 74, 76.

The capacitor leads 74, 76 and the fingers 74*f*, 76*f* that form the capacitor 71 can be any size, but it is preferred if they are as small as possible. In one embodiment, the cross-sectional dimensions of the capacitor leads 74, 76 and the capacitor fingers 74*f*, 76*f* can be about 0.008 inches by about 0.010 inches. The capacitor leads 74, 76 and the capacitor fingers 74*f*, 76*f* can have any cross-sectional shape including, for example, circular, semi-circular, square or rectangular.

The capacitor leads 74, 76 and the fingers 74*f*, 76*f* can be provided on the first layer of insulating material 72 in any of a number of ways, but it is preferred if they are plasma deposited thereon. A second layer of insulating material 78 can be applied over the exposed portions of the capacitor 71 and at least a portion of the capacitor leads 74, 76. The second layer of insulating material 78 can provide environmental protection to capacitor 71. The previous discussion of the first layer of insulating material 32 in connection with the first system 30 applies equally to the second layer of insulating material 78. While it is preferred if the capacitor leads 74, 76 and the fingers 74*f*, 76*f* are provided on a single layer of insulating material, the capacitor leads 74, 76 and the fingers 74*f*, 76*f* can be provided on more than one layer and can extend through any of the layers of insulating material discussed herein.

It should be noted that the first and second layers of insulating material 72, 78 can be have substantially identical thicknesses and can be made of substantially the same material, but one of the insulating layers 72, 78 can be different in at least one of these respects. Further, it will be appreciated that providing thin films of insulating material is only one of many ways to electrically insulate the various components of the system.

Ideally, the overall distance 80 between the outer peripheral surface 13 of the airfoil 12 and the outermost surface 82 of the second layer of insulating material 78 should be kept as thin as possible so as not to have an appreciable effect on the aerodynamic performance of the compressor. In one embodiment, the overall distance 80 is no more than about 0.040 inch.

Figure 7:
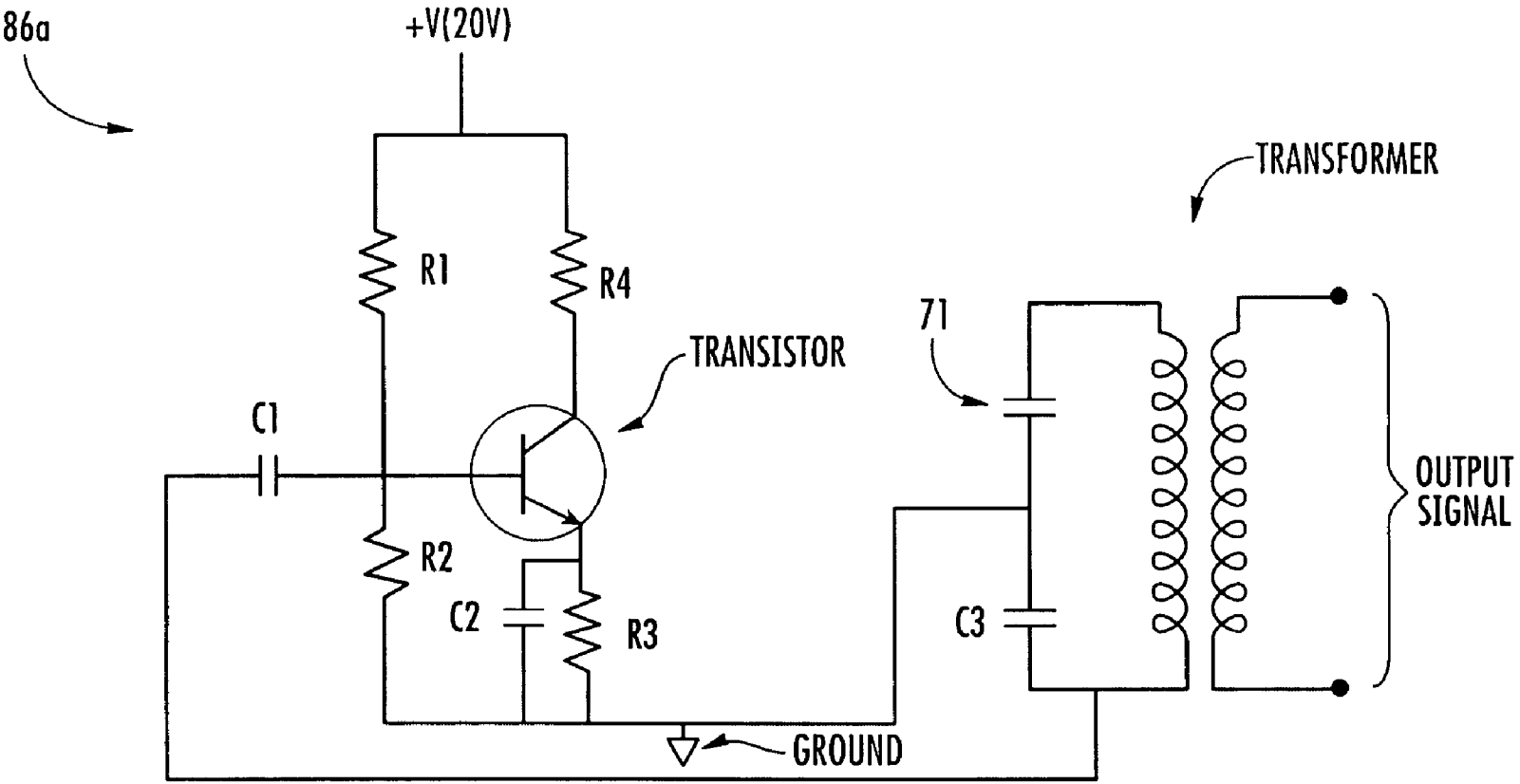
FIG. 7 is a diagrammatic view of an oscillator circuit that can be used according to aspects of the invention.

The capacitor leads 74, 76 can extend away from the capacitor 71. Each of the capacitor leads 74, 76 can be electrically connected with a respective conductor 84, which can be, for example, conventional electrical wires. The electrical connection between the capacitor leads 74, 76 and the conductors 84 can occur on the airfoil 12, preferably near the outer radial end 16 of the airfoil 12. Alternatively, the electrical connection can occur on the outer shroud 20. The conductors 84 can extend outside of the compressor (not shown). In one embodiment, the conductors 84 can be electrically connected to an external electrical circuit, such as an oscillator circuit 86. Thus, the capacitor 71 can be an active component of the oscillator circuit 86. In one embodiment, the oscillator circuit 86 can be a Colpitts oscillator circuit. One oscillator circuit 86*a* according to aspects of the invention is shown in FIG. 7. The individual components of the oscillator circuit 86*a* are known and will not be specifically identified or described herein. It should be noted that, in addition to the capacitor 71, other components of the oscillator circuit 86*a* can be provided on the airfoil 12 in any of the manners discussed herein.

The frequency of the oscillator circuit 86 can be measured by, for example, a digital counting circuit that can be gated by a precision timer circuit. The frequency of the oscillator circuit 86 is a function of the capacitance of the capacitor 71. More particularly, the frequency of the oscillator circuit 86 is indirectly related to the capacitance of the capacitor 71. When there is no water or ice on the outer peripheral surface 13 of the airfoil 12 or, more generally, on the outermost surface 82 of insulating material, the capacitor 71 can have an associated base capacitance, and the circuit 86 can have a base frequency. However, when water adheres to or ice forms on these surfaces, the high dielectric constant of the water molecules can result in a proportional increase in the capacitance, which, in turn, can result in a proportional drop in the frequency of the oscillator circuit 86. Such a change in frequency can be detected by measurement, thereby alerting an operator of the presence of liquid water or ice. The operator can take action to remedy the situation before damage occurs, such as by changing operating conditions or shutting down the engine.

Figure 8:
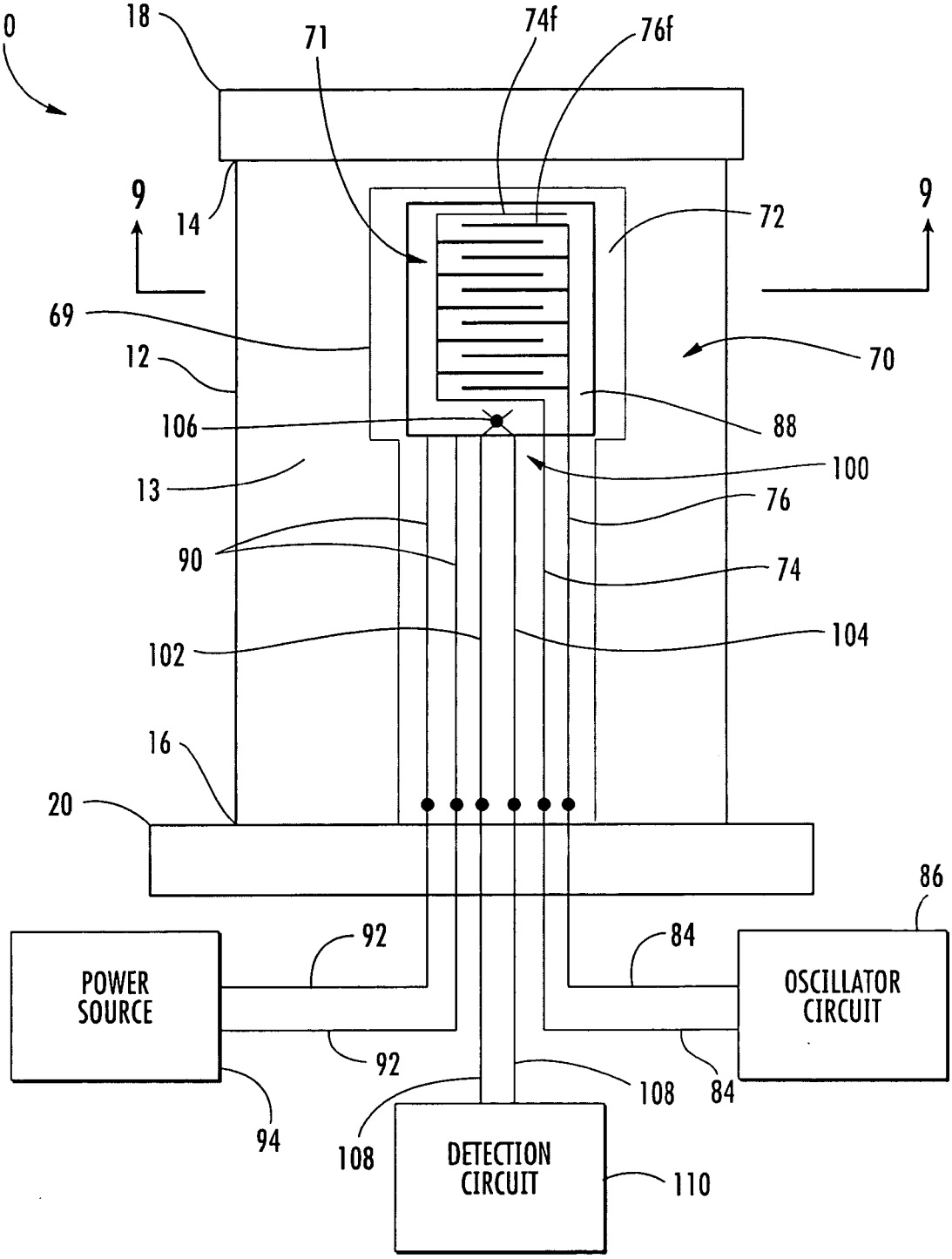
FIG. 8 is a side elevational view of a compressor vane with an alternative embodiment of the second detection system according to aspects of the invention, wherein the second and third layers of insulating material are removed for clarity.
Figure 9:
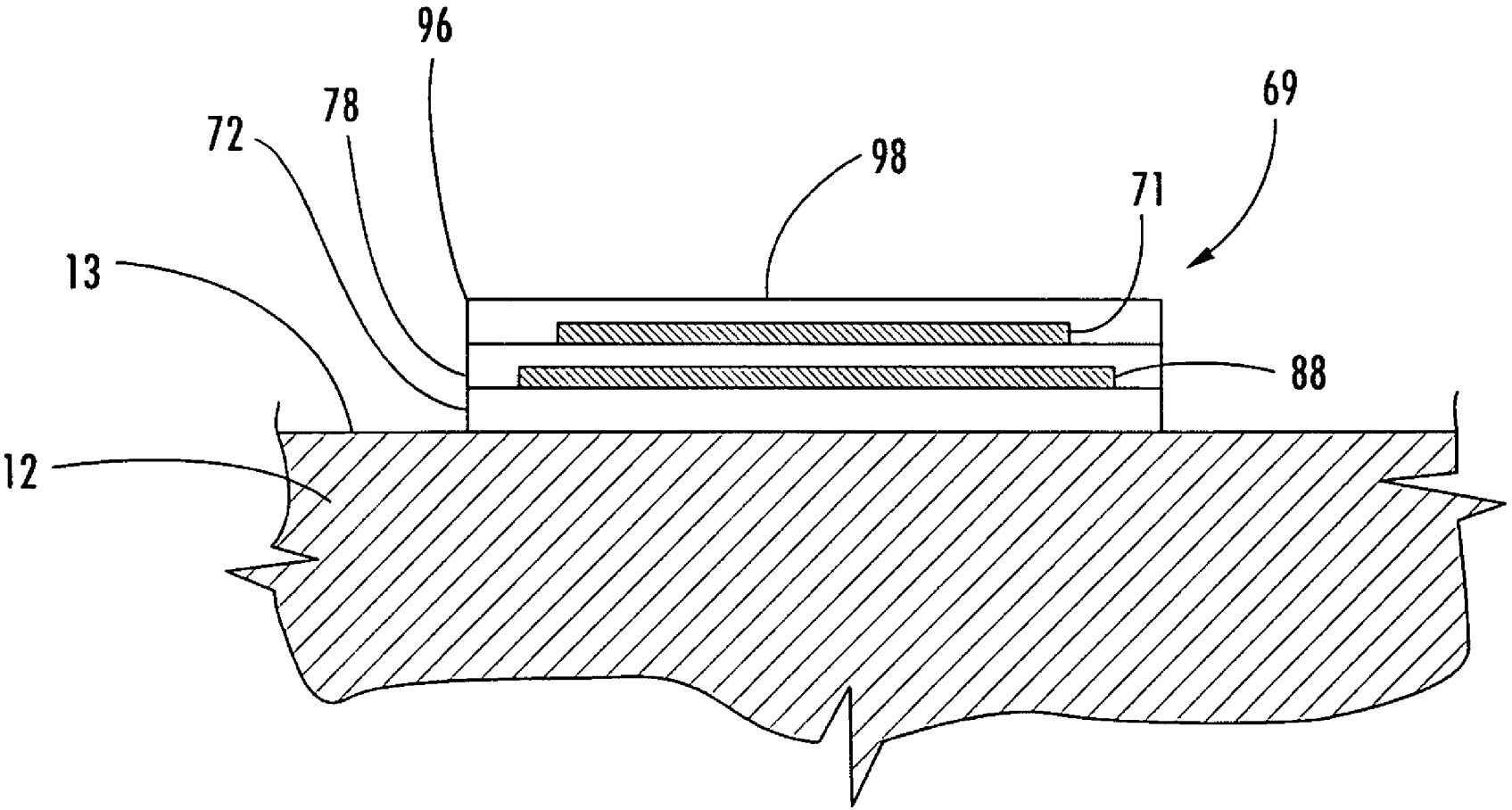
FIG. 9 is a cross-sectional view of the alternative embodiment of the second detection system according to aspects of the invention, viewed from line 8—8 in FIG. 7.

In one embodiment, the system 70 can be adapted to remove the ice and/or water from the airfoil 12 during on-line engine operation, as shown in FIGS. 8–9. To that end, the system 70 can further include a heater 88. A pair of heater leads 90 can be electrically connected to the heater 88 and extend therefrom. Each of the heater leads 90 can be electrically connected to a respective conductor 92, which can extend outside of the compressor (not shown). The conductors 92 can be electrically connected to a power source 94, which can be an alternating or direct current source. The earlier discussion of such components (i.e., heater 38, heater leads 40, conductors 42, and power source 44) is equally applicable here and in incorporated by reference.

In one embodiment, at least a portion of the heater 88 can be located directly beneath the capacitor 71. In another embodiment, the heater 88 can be provided such that no portion of the heater 88 overlaps the capacitor 71. Regardless of the relative position of the heater 88 and capacitor 71, these components can be electrically insulated. In one embodiment, the heater 88 and the capacitor 71 can be provided on the same layer of insulating material. In another embodiment, the heater 88 and the capacitor 71 can be on different layers of insulating material, as shown in FIG. 9. In such case, the second layer of insulating material 78 can electrically insulate the heater 88 and the capacitor 71. In addition, a third layer of insulating and/or protective material 96 can be applied so as to substantially encapsulate the capacitor 71. In any case, it is preferred if the amount by which the outermost surface 98 extends beyond the outer peripheral surface 13 of the airfoil 12 is kept to a minimum, such as to about 0.040 inch or less.

Thus, when the capacitor detects ice or water, as discussed above, the heater 88 can be activated to deice and dry the nearby area to confirm the presence of ice and/or water. That is, once the ice and water is removed, the frequency of the circuit should change so as to be substantially at or near the baseline frequency. It will be appreciated that the heater 88 can be used to calibrate the capacitor 71 by establishing the base oscillator frequency under conditions where no ice or water is present.

This system can include at least one thermocouple 100 to verify surface temperature and that all surface water has been removed. In one embodiment, the thermocouple 100 can be provided on the airfoil 12, as shown in FIG. 8. The thermocouple 100 can include a first thermocouple lead 102 and a second thermocouple lead 104. The first and second thermocouple leads 102, 104 are made of different materials. For instance, the first thermocouple lead 102 can be made of a nickel chrome alloy, and the second thermocouple lead 104 can be made of a nickel aluminum alloy. At one point, the thermocouple leads 102, 104 can overlap each other. In the area of overlap, the thermocouple leads 102, 104 can be electrically connected so as to form a thermocouple junction 106. The thermocouple junction 106 can be located substantially directly over a portion of the heater 88, or the thermocouple junction 106 can be located elsewhere.

The earlier discussion of thermocouple leads 48*a*, 48*b* applies equally to the thermocouple leads 102, 104 and is incorporated by reference. The thermocouple 100 and the capacitor 71 can be provided on the same layer of insulating material, such as the second layer 78. However, at least a portion of the thermocouple 100 or the capacitor 71 can be on different layers as well.

Each of the thermocouple leads 102, 104 can be electrically connected to a respective conductor 108 that can extend outside of the compressor (not shown). Preferably, the conductors 108 are made of the same material or a substantially identical material as the thermocouple leads 102,104. The conductors 108 can be electrically connected, directly or indirectly, to a detection circuit 110, which can convert the measured thermocouple junction voltage into temperature. It will be appreciated that the thermocouple 100 can be used to confirm that ice and/or water has been removed from the airfoil 12 or, more particularly, from the outermost surface 98 of the third layer of insulating material 96. The manner in which the thermocouple 100 can be used to detect the presence of ice and/or water has been described above in connection with thermocouple 48.

Figure 10:
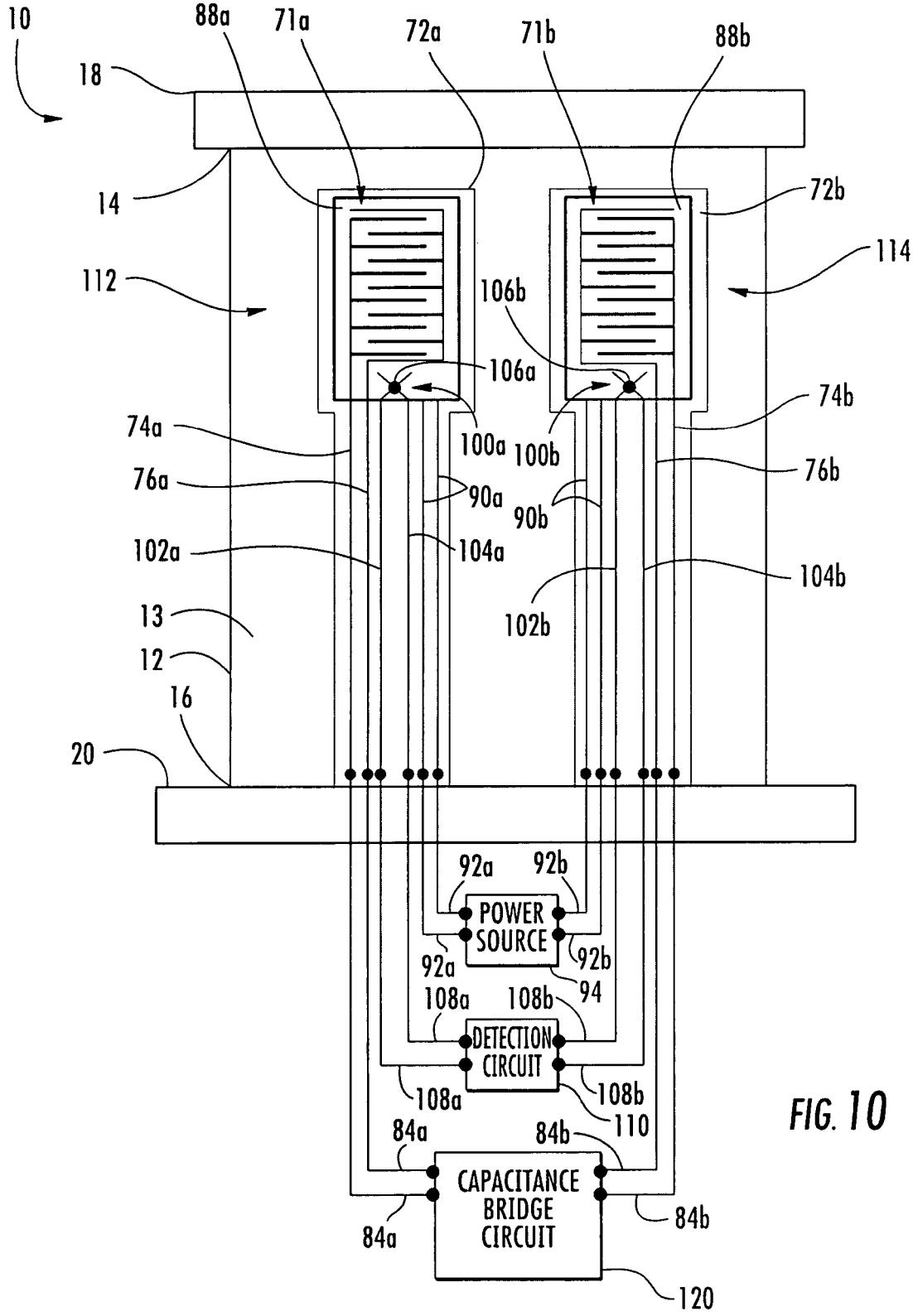
FIG. 10 is a side elevational view of a compressor vane with another alternative embodiment of the second detection system according to aspects of the invention.

In another embodiment, two of the above capacitor-heater systems can be provided. As shown in FIG. 10, a first capacitor-heater system 112 and a second capacitor-heater 114 can be provided on the airfoil, as shown in FIG. 10. The first capacitor-heater system 112 includes a first capacitor 71*a* and a first heater 88*a*; the second capacitor-heater system 114 includes a second capacitor 71*b* and a second heater 88*b*. The above discussion regarding the heater and capacitor features as well as their combination applies equally here. The first capacitor 71*a* can include capacitor conductors 102*a*, 104*a*, and the second capacitor 71*b* can include capacitor conductors 102*b*, 104*b* can extend from the second capacitor 71*b*. Each of the conductors 102*a*, 104*a* of the first capacitor 71*a* can be electrically connected to a respective conductor 84*a*. Likewise, each of the conductors 102*b*, 104*b* of the second capacitor 71*b* can be electrically connected to a respective conductor 84*b*. The conductors

Figure 11:
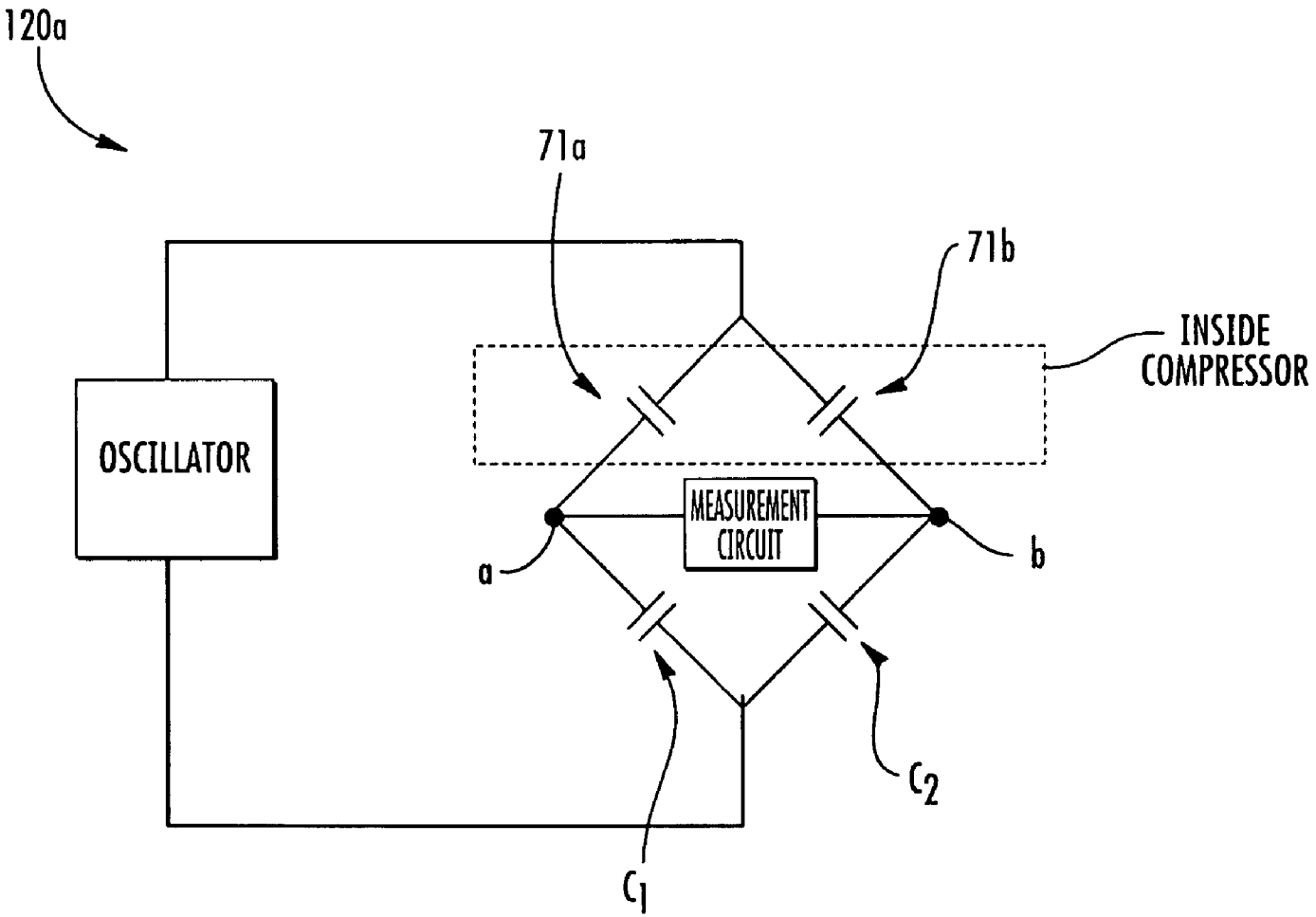
FIG. 11 is a diagrammatic view of a capacitance bridge circuit that can be used according to aspects of the invention.

84*a*, 84*b* can extend outside of the compressor (not shown) and used to complete an external circuit, such as a capacitance bridge circuit 120. One example of a capacitance bridge circuit 120*a* according to aspects of the invention is shown in FIG. 11. The individual components of the capacitance bridge circuit 120*a* are known and will not be specifically identified or described herein. However, it should be noted that, in addition to the first capacitor 71*a* and the second capacitor 71*b*, other components of the capacitance bridge circuit 120*a* can be provided on the airfoil 12 in any of the manners discussed herein.

A first pair of heater leads 90*a* can extend from the first heater 88*a*, and a second pair of heater leads 90*b* can extend from the second heater 88*b*. Each of the first heater leads 90*a* can be electrically connected with a respective conductor 92*a*. Similarly, each of the second heater leads 90*b* can be electrically connected with a respective conductor 92*b*. The conductors 92*a*, 92*b* can extend outside of the compressor (not shown) and brought into electrical communication with the power source 94, such as an alternating or direct current source.

According to aspects of the invention, the capacitance bridge circuit 120*a* can be balanced, such as by adjusting variable capacitor C1, under conditions where no ice or water is substantially above or near each of the capacitor-heater systems 112, 114, such as a known operating point or when both heaters 88*a*, 88*b* are active. After balancing the circuit 120*a*, one of the heaters, such as the first heater 88*a*, can remain activated, or one heater can be activated during a test. Thus, the heater 88*a* can substantially prevent ice from forming and water from adhering to the surface 98 above or near the first heater-capacitor system 112. If ice or water is present substantially at or near the second heater-capacitor system 114, particularly the second capacitor 71*b*, the capacitance bridge circuit 120*a* can become unbalanced, producing a substantial voltage signal across points a and b (see FIG. 11). Thus, it will be appreciated that this bridge circuit configuration 120*a* can cancel out substantially all common factors affecting the capacitance of the first and second capacitors 71*a*, 71*b*.

The capacitance bridge circuit 120 can then provide an imbalance signal proportional to the thickness of ice on the unheated capacitor. This differential technique can cancel all common mode capacitor-heater system factors in the measurement, including inert material deposits and lead dependence. Further, in one embodiment, a first thermocouple 100*a* can be associated with the first capacitor-heater system 112, and a second thermocouple 100*b* can be associated with the second capacitor-heater system 112. The first thermocouple 100*a* has a pair of thermocouple leads 102*a* and 104*a* that cross to form a thermocouple junction 106*a*. Similarly, the second thermocouple 100*b* has a pair of thermocouple leads 102*b* and 104*b* that cross to form a thermocouple junction 106*a*. Each of the thermocouple leads 102*a*, 104*a* can be electrically connected with a respective conductor 108*a*, and each of the thermocouple leads 102*b*, 104*b* can be electrically connected with a respective conductor 108*b*. The conductors 108*a*, 108*b* can be electrically connected to the detection circuit 110, which can convert the measured voltage at each thermocouple junction 106*a*, 106*b* into a temperature value. The detection circuit 110 can be a single circuit for both thermocouples 100*a*, 100*b*; alternatively, the detection circuit 110 can be individual detection circuits for each thermocouple 100*a*, 100*b*. The previous discussion concerning thermocouple 100 is equally applicable to the first and second thermocouples 100*a*, 100*b*. As explained earlier, the thermocouples 100*a*, 100*b* can be provided to verify surface temperature, and that all surface water and/or ice has been removed.

It will be appreciated that any of the foregoing embodiments according to aspects of the invention can be used in connection with at least one airfoil in a row of airfoils. Further, aspects of the invention can be used in connection with a single row of airfoils or with more than one row of airfoils. In addition, for any given airfoil, embodiments of the invention can be applied to just a portion of the airfoil. Alternatively, aspects of the invention can be applied about substantially the entire outer peripheral surface of the airfoil. It will be understood that the various embodiments of the invention can be used in isolation or in combination with each other.

The foregoing description is provided in the context of various possible systems for detecting the presence of ice or liquid water on the surface of a compressor airfoil. While the foregoing discussion has been directed to systems in combination with a compressor vane, it will be readily appreciated that aspects of the invention can be applied to other components in the compressor section of the engine. Further, aspects of the invention are particularly well suited for use in the detection of water or ice on the component surface, but it will be understood that the invention can be used to detect the presence of other liquids that can potentially freeze or otherwise solidify on the surface of a compressor component during engine operation. Thus, it will of course be understood that the invention is not limited to the specific details described herein, which are given by way of example only, and that various modifications and alterations are possible within the scope of the invention as defined in the following claims.

What is claimed is:

1. A surface wetting and icing detection system for a turbine engine compressor comprising:

a turbine engine compressor component having a surface;

an insulating coating applied on at least a portion of the component surface, the coating having an outermost surface;

a heater provided proximate the outermost surface so as to selectively provide heat to the outermost surface;

a power source for selectively activating the heater;

a first thermocouple provided proximate the outermost surface, the first thermocouple having a first lead and a second lead, a portion of the first lead being electrically connected to a portion of the second lead to form a first thermocouple junction, wherein the first thermocouple junction is positioned proximate the heater so as to sense heat from the heater; and a detection circuit operatively connected to the thermocouple, wherein the detection circuit measures voltage at the first thermocouple junction and converts the measured voltage into a temperature value, wherein, when no water and ice is present on the outermost surface, the thermocouple measures a base temperature value in response to a heater pulse, and wherein, when at least one of water and ice is present on the outermost surface, the thermocouple measures a measured temperature value in response to a heater pulse, wherein the measured temperature value is less than base temperature value, whereby the lower measured temperature value alerts an operator of the presence of at least one of ice and water on the compressor component.

2. The system of claim 1 wherein the compressor component is an airfoil.

3. The system of claim 1 wherein the coating is one of thermal baffler coating, silicone oxide, zirconium, aluminum oxide, and magnesium fluoride.

4. The system of claim 1 wherein the first thermocouple junction is located between the heater and the outermost surface of the coating, and wherein the heater and the thermocouple are electrically insulated by the coating.

5. The system of claim 1 wherein the coating is provided in at least a first layer and a second layer, wherein the heater is electrically insulated from the component surface by the first layer, and wherein the first thermocouple is electrically insulated from the heater by the second layer.

6. The system of claim 5 further including a third layer of coating, wherein the third layer cooperates with the second layer to substantially cover the first thermocouple, wherein the third layer defines the outermost surface of the coating.

7. The system of claim 1 further including a second thermocouple provided proximate the outermost surface, wherein the second thermocouple includes a first thermocouple lead and a second thermocouple lead, a portion of the first lead being electrically connected to a portion of the second lead to form a second thermocouple junction, wherein the second thermocouple junction is located remotely from the heater so that the second thermocouple junction does not substantially sense heat generated by the heater, and wherein the second thermocouple is operatively connected to the power source and wherein the second thermocouple is electrically connected in series and in opposing polarity to the first thermocouple, whereby the dual thermocouple arrangement minimizes any contribution to the thermocouple voltage reading attributable to non-heater sources.

8. The system of claim 1 wherein the heater includes a pair of heater leads extending therefrom, wherein each of the heater leads is electrically connected to the power source by conductors, and each of the thermocouple leads is electrically connected to the detection circuit by conductors.

9. The system of claim 1 wherein the thermocouple and the heater are no more than about 0.010 inch thick.

10. The system of claim 1 wherein the distance between the component surface and the outermost surface of the coating is no more than about 0.040 inch.

11. A surface wetting and icing detection system for a turbine engine compressor comprising:

a turbine engine compressor component having a surface;

an insulating coating applied on at least a portion of the component surface, the coating having an outermost surface;

an oscillator circuit having an associated reference frequency; and a capacitor provided proximate the outermost surface, wherein the capacitor is operatively connected to and forms a part of the oscillator circuit, the capacitor having an associated capacitance, wherein, when at least one of water and ice is present on the outermost surface, the capacitance of the capacitor increases thereby causing a decrease in the frequency of the oscillator circuit, whereby the frequency decrease can alert an operator of the presence of at least one of ice and water on the compressor component.

12. The system of claim 11 wherein the compressor component is an airfoil.

13. The system of claim 11 wherein the coating is one of thermal barrier coating, silicone oxide, zirconium, aluminum oxide, and magnesium fluoride.

14. The system of claim 11 wherein the capacitor include a first capacitor lead and a second capacitor lead, wherein a plurality of fingers project from a portion of each capacitor lead, wherein the capacitor leads are ranged such that fingers of the first capacitor lead are alternatingly interspaced with the fingers of the second capacitor lead.

15. The system of claim 11 wherein the oscillator circuit is a Colpitts oscillator circuit.

16. The system of claim 11 further including:

a heater provided proximate to the outermost surface; and a power source for selectively activating the heater, whereby the heater can be activated to at least one of deice and dry at least one of the outermost surface and a portion of the surface.

17. The system of claim 16 further including:

a thermocouple provided proximate the outermost surface, the thermocouple having a first lead and a second lead, wherein a portion of the first lead is electrically connected to a portion of the second lead to form a thermocouple junction, wherein the thermocouple junction is disposed proximate the heater so as to sense heat from the heater; and a detection circuit operatively connected to the thermocouple, wherein the detection circuit measures voltage at the thermocouple junction and converts the measured voltage into a temperature value, whereby the thermocouple is used to confirm the presence of at least one of ice and water on the compressor component.

18. The system of claim 17 wherein the thermocouple junction is located between the heater and the outermost surface of the coating, and wherein the heater and the thermocouple are electrically insulated by the coating.

* * * * *